US006422554B1

(12) United States Patent
Wuethrich et al.

(10) Patent No.: US 6,422,554 B1
(45) Date of Patent: Jul. 23, 2002

(54) DOCUMENT FEEDER WITH PIVOTED LEVER

(75) Inventors: Heinz Wuethrich, Bern; Stefan Kaeser, Olten; Thomas Gasser, Bern, all of (CH)

(73) Assignee: Ascom Hasler Mailing Systems AG, Bern (CH)

( * ) Notice: Subject to any disclaimer, the term of this patent is extended or adjusted under 35 U.S.C. 154(b) by 0 days.

(21) Appl. No.: 09/505,353

(22) Filed: Feb. 16, 2000

(51) Int. Cl.[7] ..... B65H 1/24

(52) U.S. Cl. ..... 271/166; 271/137; 271/134; 271/117

(58) Field of Search ..... 271/117, 122, 271/126, 127, 131, 134, 137, 144, 166

(56) References Cited

U.S. PATENT DOCUMENTS

| | | | | |
|---|---|---|---|---|
| 549,111 A | | 11/1895 | Crowell | |
| 2,627,406 A | | 2/1953 | Mestre | 270/58 |
| 3,540,970 A | | 11/1970 | Huntwork | 156/556 |
| 3,949,981 A | | 4/1976 | McInerney | 271/178 |
| 4,034,975 A | | 7/1977 | Agnew et al. | 271/10 |
| 4,212,456 A | * | 7/1980 | Ruenzi | 271/127 X |
| 4,714,243 A | * | 12/1987 | Staniszewski | 271/127 X |
| 4,884,796 A | * | 12/1989 | Daboub | 271/126 X |
| 4,948,453 A | | 8/1990 | Nobile et al. | 156/441.5 |
| 5,370,380 A | * | 12/1994 | Suzuki et al. | 271/127 X |
| 5,674,348 A | | 10/1997 | DeFiguerido | 156/441.5 |

FOREIGN PATENT DOCUMENTS

| | | |
|---|---|---|
| DE | 295 08 615 | 9/1996 |
| DE | 295 08 615 U1 | 10/1996 |
| GB | 1519901 | 8/1978 |

OTHER PUBLICATIONS

Patent Abstracts of Japan, Publication No.: 9315609, Title: Delivery Device for Mail.

Patent Abstracts of Japan, vol. 1998, No. 4, Mar. 31, 1998 JP 09315609.

* cited by examiner

*Primary Examiner*—Christopher P. Ellis
*Assistant Examiner*—Patrick Mackey
(74) *Attorney, Agent, or Firm*—Perman & Green, LLP

(57) ABSTRACT

A document feeder employs a lifting lever to lift stacked documents away from a feed roller each time a document is being fed away from the stack. In this way the separation of documents is enhanced, providing a mechanism that more readily accommodates documents of varying shapes, thicknesses, and materials. The feeder uses a motor linked by one-way clutches to feed mechanisms for documents and for labels, stacked separately. The motor is driven in one direction to feed documents and in the other direction to feed labels. A moistener is provided below the paper path, and the moistener is mounted so that it can be slidably removed. When it is removed, feed rollers are permitted to relax and move apart which helps in the clearing of jams.

5 Claims, 6 Drawing Sheets

51
52
53
54

51
52
53
53
54

51
52
52
53
53
54

DOCUMENT FEEDER WITH PIVOTED LEVER

BACKGROUND

The invention relates generally to a feeder for documents which are to be franked in a postage meter, and relates particularly to an improved feeder which accomplishes reliable separation for individual feeding of documents from a stack even if they are of varying thicknesses and varying materials. The feeder is able to accommodate batches of documents, each batch being of documents of a particular size, but the feeder is readily adjustable to a different size of batch. Stated differently, the stack may be adjusted to one document size per batch.

A particularly difficult part of the design of any stacked document feeder is the separation of documents. It is critical that documents be passed one by one from the feeder to later equipment in the paper path, such as a postage meter. The passage of documents one by one permits the postage meter to frank each of them in a reliable way. It is important that misfeeds such as duplicate feeding of two or more documents be minimized or eliminated. It is desirable that the feeder be capable of feeding not only documents but also labels, which are used for applying postage to mail pieces that are unable to pass through the feeder and through the postage meter. It is also preferable that the feeder have a moistener with which envelopes may be moistened and sealed. With the moistener a typical problem is the need to replace parts of the moistener that age and need to be replaced, such as a sponge or brush. It is also desirable that any document jams in the feeder be easy to clear.

The many design goals just described must, of necessity, be fulfilled (if at all) within constraints of cost and size (form factor). It is thus particularly desirable to accomplish these many design goals at reasonable cost and while minimizing parts count and assembly steps.

SUMMARY

A document feeder employs a lifting lever to lift stacked documents away from a feed roller each time a document is being fed away from the stack. In this way the separation of documents is enhanced, providing a mechanism that more readily accommodates documents of varying shapes, thicknesses, and materials. The feeder uses a motor linked by one-way clutches to feed mechanisms for documents and for labels, stacked separately. The motor is driven in one direction to feed documents and in the other direction to feed labels. A moistener is provided below the paper path, and the moistener is mounted so that it can be slidably removed. When it is removed, feed rollers are permitted to relax and move apart which helps in the clearing of jams.

DESCRIPTION OF THE DRAWING

The invention will be described with respect to a drawing in several figures, of which.

Where possible, like elements in figures are shown with like reference designations.

DETAILED DESCRIPTION

Figure 1:
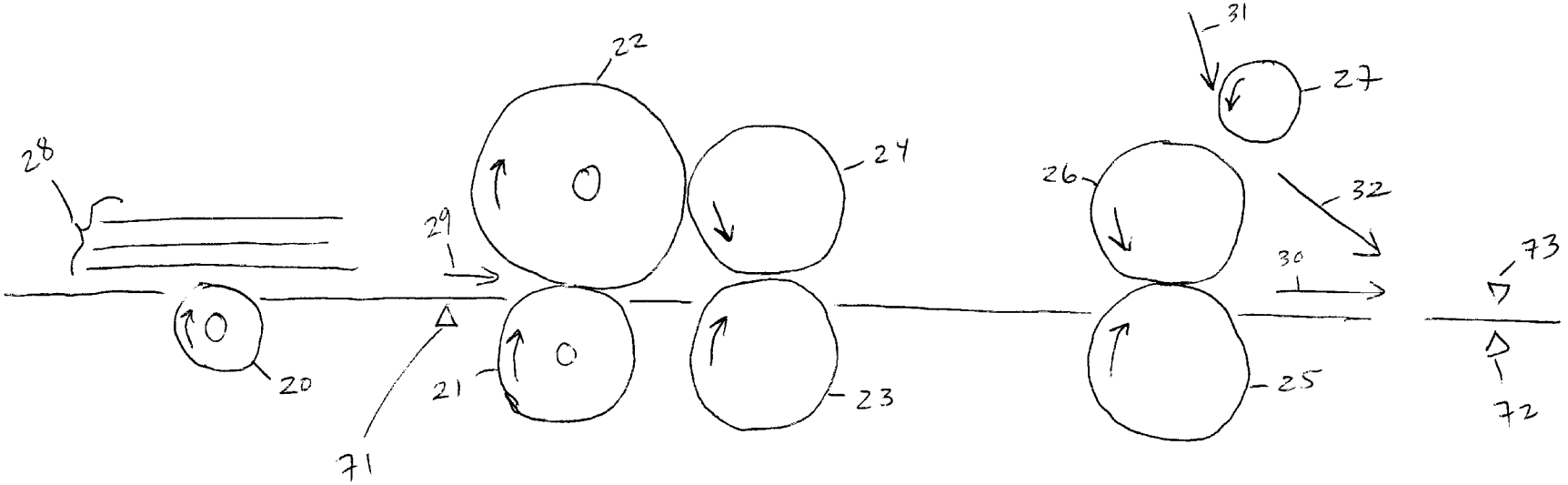
FIG. 1 is a cross section showing feeder elements such as rollers which interact directly with mail pieces and labels.

FIG. 1 is a cross section showing feeder elements such as rollers which interact directly with mail pieces and labels. Mail pieces 28, typically documents such as cards or envelopes, may be stacked by a user in a stacking area above roller 20. Guides, omitted for clarity in FIG. 1, define the stacking area and are adjustable for various sizes of envelopes and cards. A mail piece may proceed along a paper path beginning at arrow 29 and may eventually reach a later (downstream) portion of the paper path as shown by arrow 30. Later the mail piece desirably enters a postage meter (franking machine) most of which is omitted for clarity from FIG. 1.

The movement of a mail piece from the stacking area to the postage meter is as follows. First, a mail piece triggers the sensor 71. This may be because a stack of documents is in the stacking area, in which case the bottom piece reaches the sensor 71. Alternatively, instead of a stack of documents, it may happen that a single document is hand-fed into the feeder, thus triggering the sensor 71.

Next the mail piece (for example, the bottom piece of the stack 28, or an individually hand-fed mail piece) is driven along the paper path (rightwards in FIG. 1) to roller 21. A counter-rotating roller 22 rotates (clockwise in FIG. 1). The roller 22 has a rubber ring as described further below, which tends to repel mail pieces other than the bottom mail piece, forcing them backwards in the paper path (leftwards in FIG. 1). This prevents or at least minimizes double feeding. Separation of stacked pieces is always difficult, but this separator roller 22 helps in the process of separation.

The mail piece that is being fed (that is, the bottom piece of the stack 28 or an individually hand-fed mail piece) is gripped roller 21 and a rib on roller 22. Roller 21 carries the mail piece further along the paper path until it is gripped by rollers 23, 24. One of these rollers is a driver roller, while the other is an idler roller, driven by contact with the driver roller or by contact with a mail piece that moves because of contact with the driver roller. In an exemplary embodiment, roller 24 is a driver roller and roller 23 is the idler roller. Roller 23 is spring-loaded and is able to move downward to accommodate thicker mail pieces.

Rollers 23, 24 carry the mail piece further along the paper path until it is gripped by rollers 25, 26. One of these rollers is a driver roller, while the other is an idler roller, driven by contact with the driver roller or by contact with a mail piece that moves because of contact with the driver roller. In an exemplary embodiment, roller 26 is a driver roller and roller 25 is the idler roller. Roller 25 is spring-loaded and is able to move downward to accommodate thicker mail pieces.

As will be described below in connection with the moistener 65, it is desirable that the spring loading of rollers 23, 25 be linked (for example by camming surfaces) with the position of the moistener 65.

As will be appreciated, all of the rollers which are below the paper path (that is, rollers 20, 21, 23, and 25) rotate clockwise in FIG. 1, thereby urging any mail piece in the direction of the paper path toward the postage meter (to the right in FIG. 1). It will also be appreciated that all of the rollers that are above the paper path (except the separator roller 22) rotate counter-clockwise in FIG. 1, likewise urging any mail piece in the direction of the paper path toward the postage meter. Those skilled in the art will appreciate that rollers 20, 21, 23, and 25 are preferably set up so that the each roller that is further long in the paper path has a tangential velocity no less than, and preferably greater than, the tangential velocity of the roller preceding it in the paper path.

FIG. 1 also shows the moving elements associated with the printing of labels. When a label is to be printed, roller 27 rotates counterclockwise in FIG. 1, drawing a label downward along label path 31. The label proceeds past but preferably does not touch roller 26 (which rolls clockwise during label feeding) and along path 32, into the postage meter.

Roller 20 contacts mail pieces with a relatively "live" surface such as neoprene black, rubber 35° shore. Roller 21 is likewise a relatively "live" surface such as neoprene black, rubber 45° shore.

Roller 22 has a rubber ring (mentioned above) which may be PU UK2 55° shore, green. The main body of roller 22 may be POM. Roller 27 may be neoprene black, rubber 35° shore. ("Shore" is an industry-standardized measure of hardness for flexible materials.)

A sensor 71 senses presence of at least one mail piece in the stacker area. Sensors 72, 73 are located in a post meter (franking machine), most of which is omitted for clarity in FIG. 1. In an exemplary embodiment, these sensors are LED-phototransistors operating in an infrared wavelength.

The sequence of steps for franking an envelope or other mail piece are as follows. A mail piece or a stack of mail pieces are placed in the stacking area, an event sensed by sensor 71. This information is made available by the feeder to the postage meter via a communications channel. At some point, the postage meter becomes ready to frank, learns of the presence of a mail piece at sensor 71, and communicates with the feeder. The result of this communication is that the feeder begins feeding. Rollers 20, 21, 22, 23, 24, 25, and 26 rotate as described above, and one or more mail pieces are passed singly along the paper path 29, 30 to the postage meter, past sensors 72, 73. The mail pieces are franked.

The sequence of steps for franking a label are as follows. One or more labels are stacked in a label stacking area, omitted for clarity in FIG. 1. At some point, the user communicates to the postage meter that it is desired to frank a label, and the meter communicates with the feeder. The result of this communication is that the feeder begins feeding a label. Rollers 26 and 27 rotate as described above, and one label is passed singly along the paper path 32 to the postage meter, past sensors 72, 73. The label is franked. The motor is operated for a period of time selected to be sufficient to pass one label through the feeder.

It will be appreciate that one skilled in the art may devise obvious variations on this arrangement, deviating in no way from the invention. For example, the manner in which the user communicates that a label is to be franked need not be by means of a communication to the postage meter, but may as well be a communication to the feeder or to some other communicatively coupled equipment.

Figure 2:
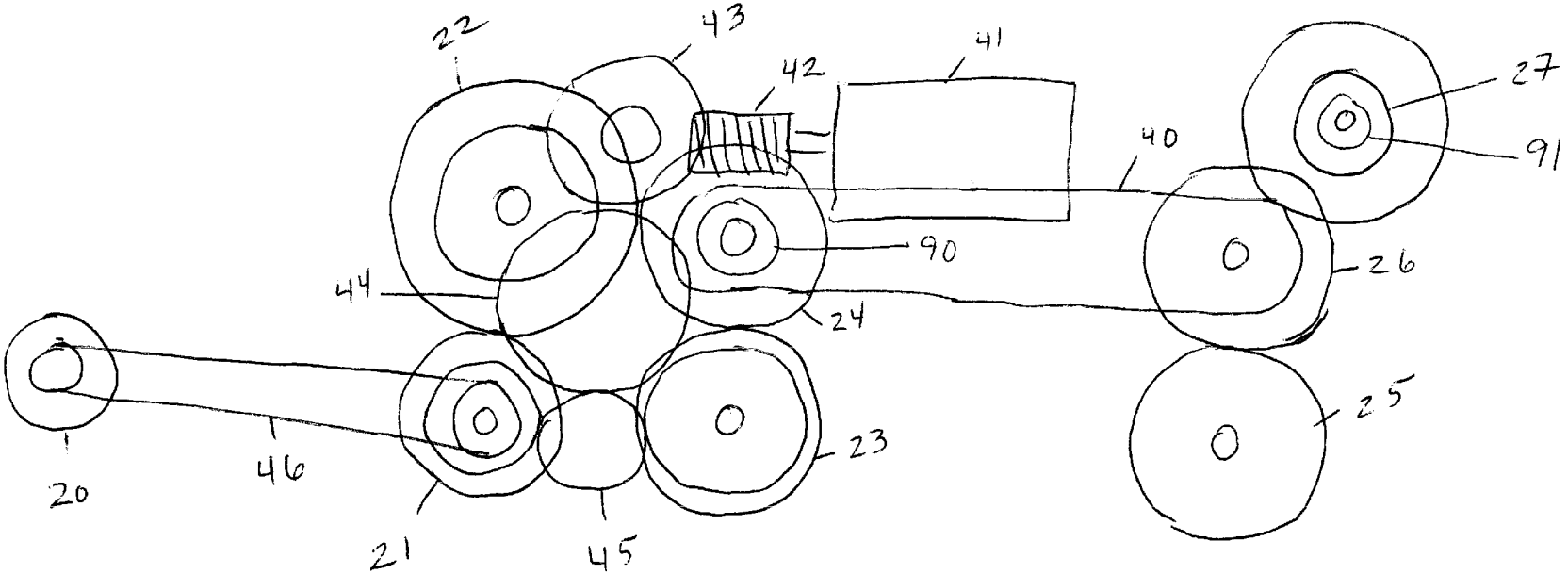
FIG. 2 is a side view showing the driving interactions among the feeder elements of FIG. 1.

FIG. 2 is a side view showing the driving interactions among the feeder elements of FIG. 1. A motor 41 has a worm gear 42 engaging a corresponding gear on the shaft of roller 24. Roller 24 is belted to roller 26. Thus when motor 41 rotates in one direction (the direction for envelope feeding), rollers 24 and 26 rotate counterclockwise in FIG. 1, and idler rollers 23, 25 rotate clockwise. On the other hand, when motor 41 rotates in its other direction (the direction for label feeding), rollers 24 and 26 rotate clockwise in FIG. 1, and idler rollers 23, 25 rotate counterclockwise.

Importantly, one-way clutches 90, 91 are provided. When roller 26 rotates in the direction for label feeding (clockwise in FIG. 1), then clutch 91 grips and causes roller 27 to rotate (counterclockwise in FIG. 1) to feed a label. When roller 26 rotates the other direction, clutch 91 relaxes and roller 27 does not rotate. The clutches 90, 91 may be spring-type clutches or roller clutches.

In either direction of rotation, rollers 23 and 25 are idlers, simply following the motion of their respective rollers 24, 26.

In a similar way, roller 24 drives gear 44 but only through clutch 90. This, when roller 24 rotates in the direction for envelope feeding (counterclockwise in FIG. 1), clutch 90 grips and causes gear driving of gear 44, clockwise. When roller 24 rotates the other direction, clutch 90 relaxes and gear 44 does not rotate.

Gear 44 engages further with gears 43 and 45, and through them to rollers 21 and 22. In this way, rotation of roller 24 in the direction for envelope feeding (counterclockwise in FIG. 1) causes rotation of rollers 21 and 22, both clockwise in FIG. 1. Belt 46 links rollers 21 and 20 so that roller 20 also rotates clockwise in FIG. 1.

It will thus be appreciated that the use of the clutches 90, 91 permits many benefits for the feeder. It becomes necessary to provide only one motor, rather than more than one, to permit feeding mail pieces and labels. The motor is heavy, and reducing the number of motors saves weight and bulk. The overall complexity of the apparatus is reduced, since there need not be levers, solenoids, electrically operated clutches, or other break-prone moving parts to shift the feeder from mail piece mode to label mode and back again. The wire count and connector pin count is reduced because of the reduction in the number of motors.

Figure 3:
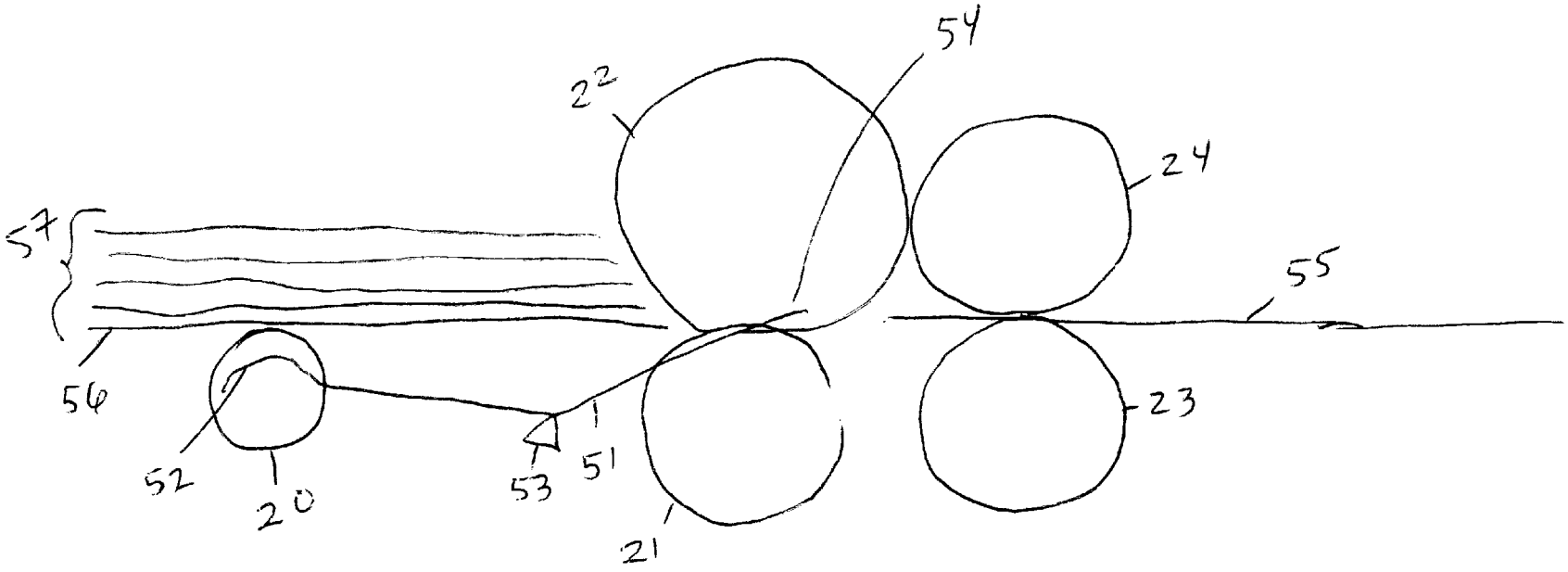
FIGS. 3 and 4 are cross sections showing a feeder lever in first and second positions.
Figure 4:
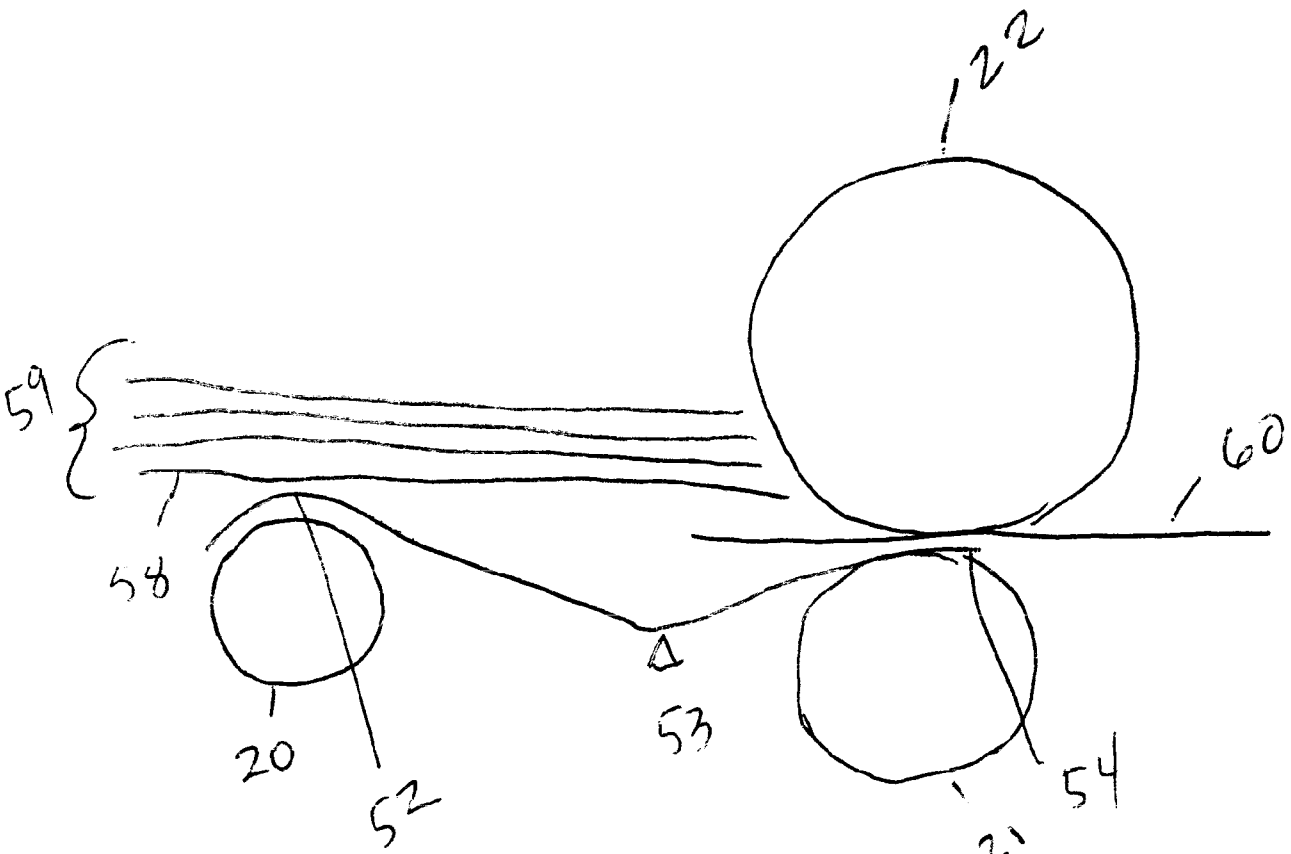

FIGS. 3 and 4 are cross sections showing a feeder lever 51 in first and second positions. In FIG. 3, there is no mail piece between rollers 21 and 22. There may well have been a previous mail piece 55 which would have previously passed through and beyond rollers 21, 22 in which case it may have reached rollers 23, 24. Feeder lever 51 importantly pivots at pivot point 53 which is between roller 20 and roller 21 and in this embodiment is located below the paper path. Although not shown in FIG. 3 for clarity, rollers 21 and 22 are each bipartate, each having an axial spacing between its two parts. The two axial spacings are one above the other, positioned to allow end 54 of lever 51 to move up and downward above and below the paper path. In FIG. 3 the end 54 has moved upward to a position above the paper path, surrounded by the two parts of the roller 22.

Figures 6A, 6B, 6C:
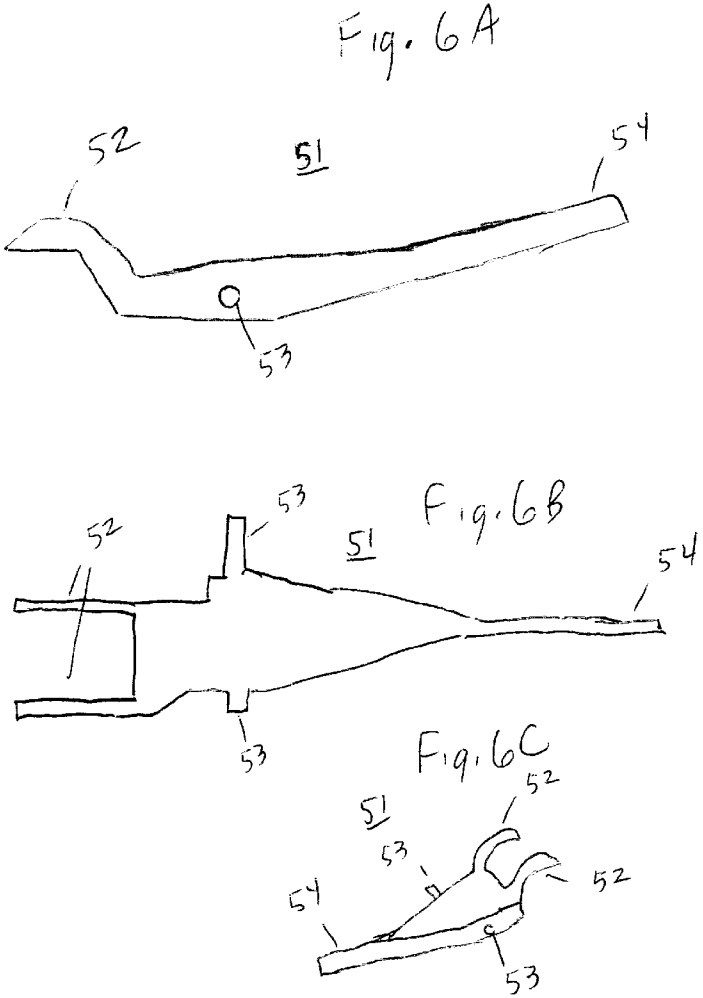
FIGS. 6A, 6B, and 6C show the feeder lever of FIGS. 3 and 4 in greater detail in side, top, and perspective views respectively.
Figure 1:
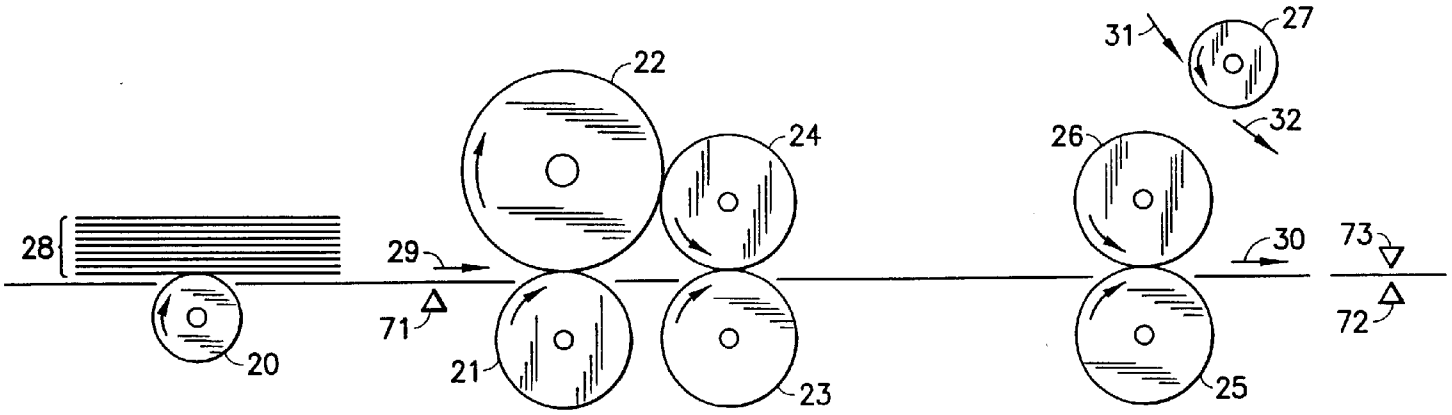
Figure 2:
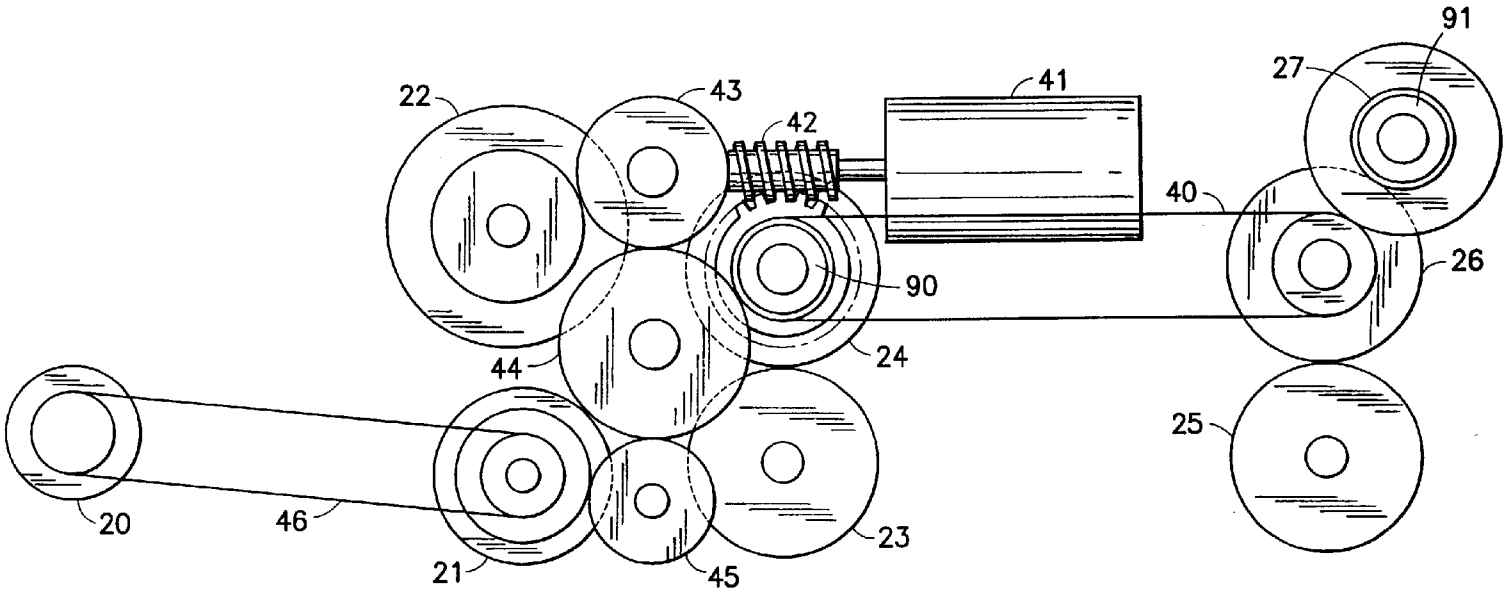
Figure 3:
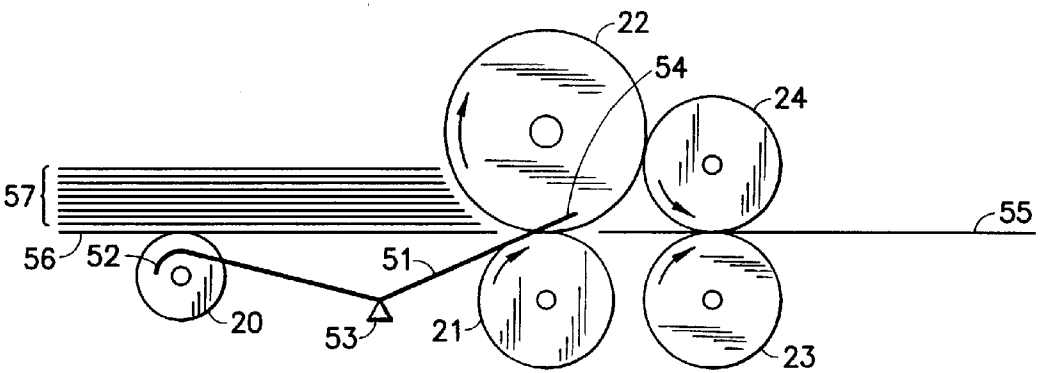
Figure 4:
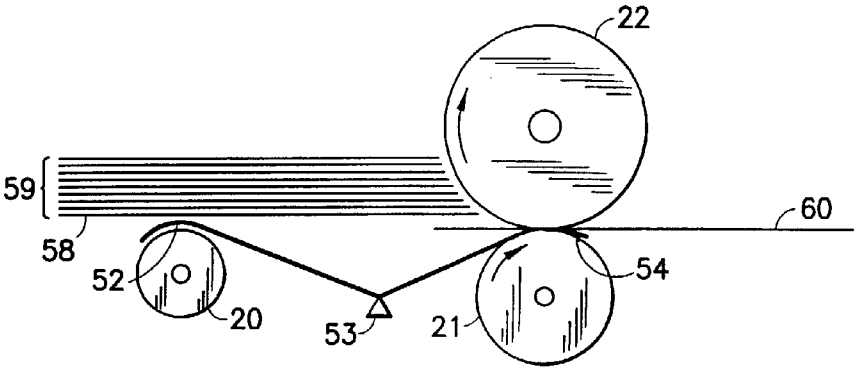
Figure 5:
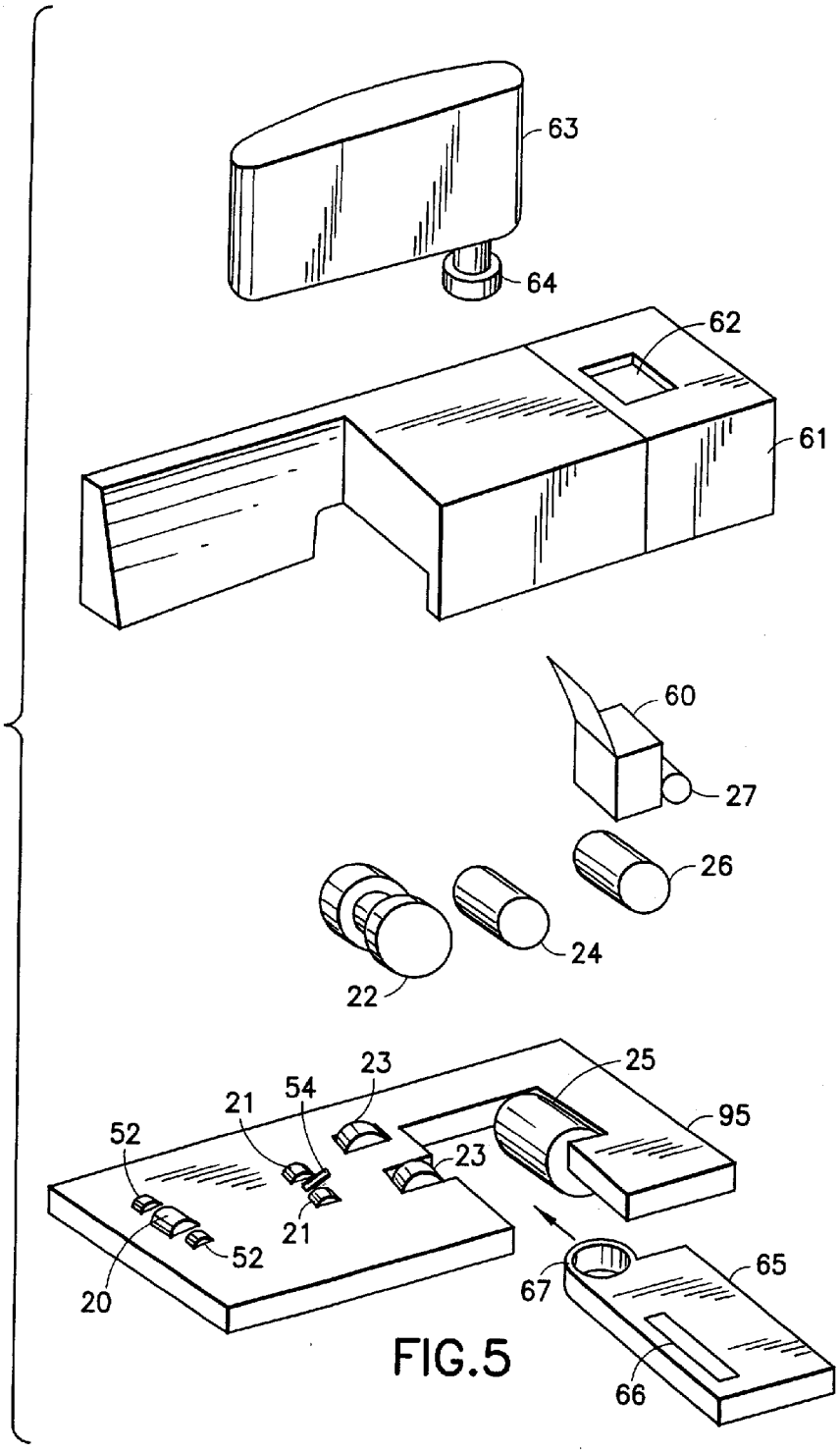
Figure 6A:
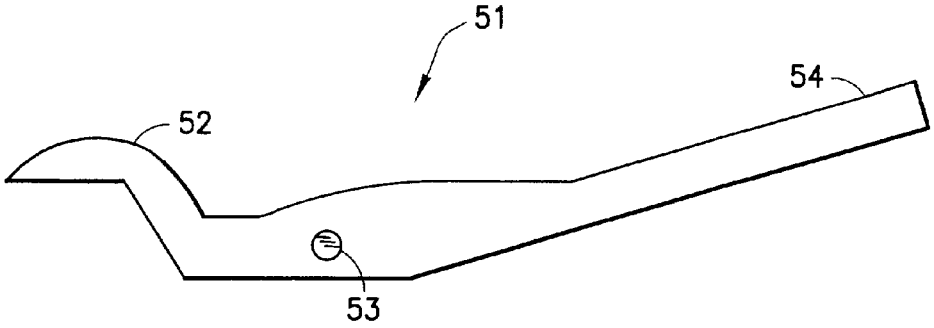
Figure 6B:
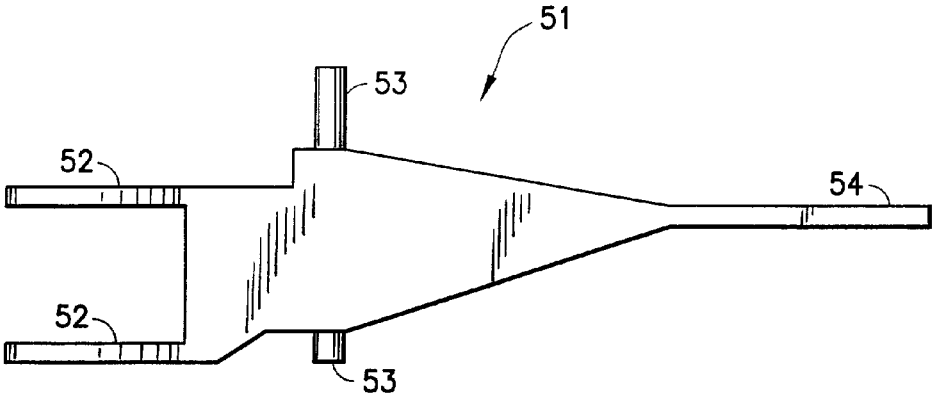
Figure 6C:
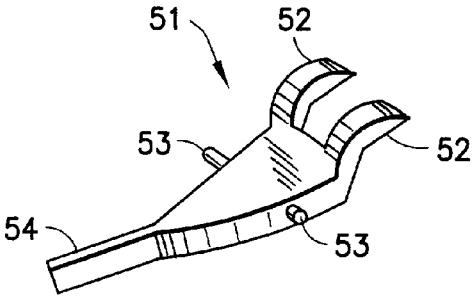

Turning briefly now to FIGS. 6A, 6B, and 6C, what is shown is the feeder lever 51 in more detail. Side view FIG. 6A shows the pivot point 53, the end 54, and end 52. FIG. 6B is a top view revealing that end 52 is desirably bipartate with the two parts of end 52 straddling roller 20. FIG. 6C shows these details in a perspective view.

Returning now to FIG. 3 it may be seen why the end 54 moved upward, namely that the mail pieces 57 press downward on end 52. As mentioned above, lever end 52 is preferably bipartate, with portions located axially at either end of the roller 20.

Now consider the sequence of events in FIG. 3 when the feeder operates. The bottom mail piece 56 (in the stack 57) is in frictional contact with roller 20. When roller 20 rotates, the mail piece 56 is urged along the paper path (rightward in FIG. 3) toward roller 21.

Turning now to FIG. 4, we see the consequences of a mail piece (now shown with reference numeral 60) having reached the roller 21. The mail piece 60, being stiff, presses the lever end 54 downwards into the space between the two parts of roller 21. The geometry of the lever 51 and the nearby structure is such that downward motion of end 54, given fixed pivot point 53, results in upward motion of end 52. This lifts the bottom mail piece 58 (if present) and any other mail pieces in the stack 59 (if present) upwards, and none of the mail pieces in the stack 59 is in contact with roller 20.

Stated differently, what is shown is a feeding method including the steps of:

allowing documents 57 in the stack area to come in contact with a first roller 20 (FIG. 3), passing a lowermost document 56 in the stack area in the exit direction, lifting the documents 59 in the stack area above the first roller 20 when the lowermost document 56, 60 reaches a second roller 21 (FIG. 4), and allowing documents 57 in the stack area to come in contact with the first roller 20 after the lowermost document 55 has passed the second roller 21 (FIG. 3).

Those with experience in the separation of pieces will appreciate that separating uniform pieces (such as separating sheets for printing in a printer) is difficult, but that separating non-uniform pieces (such as separating a stack of non-identical envelopes) is even more difficult. The task is even more difficult if the envelopes are of differing thicknesses or contain other matter such as staples and paper clips. It will thus be appreciated by those skilled in the art of feeding envelopes and other mail pieces that the lever 51 contributes substantially to the successful separation of envelopes and other mail pieces. This lever 51, especially when combined with the counter-rotating roller 22, achieves very successful separation, even with envelopes and other potentially non-uniform mail pieces.

One skilled in the art will of course appreciate that obvious variations may be devised which permit the great benefits of the lever 51 while departing from the precise configuration just described. For example, while it is considered desirable that the rollers 21 and 22 are each bipartate with portions to one side of the lever end 54 and to its other side, unitary rollers 21 and 22 could likely be used with the lever end axially disposed to one end or the other of the rollers 21, 22.

In an exemplary embodiment the motor 41 is a DC motor, but could as well be a stepper motor or any other reversible motor. Those skilled in the art will appreciate that while it is most desirable to use a single motor and two clutches to accomplish the separate mail piece and label feeding functions, it would be possible to forgo those savings by using two distinct motors, one for each feeding function, still obtaining the desirable paper separation functions described in connection with lever 51. In such a case the motors could be AC motors. Likewise it will be appreciated that while it is most desirable to use the lever 51, the lever 51 could be omitted and the benefits of the use of a single motor and two clutches would be retained.

Figure 5:
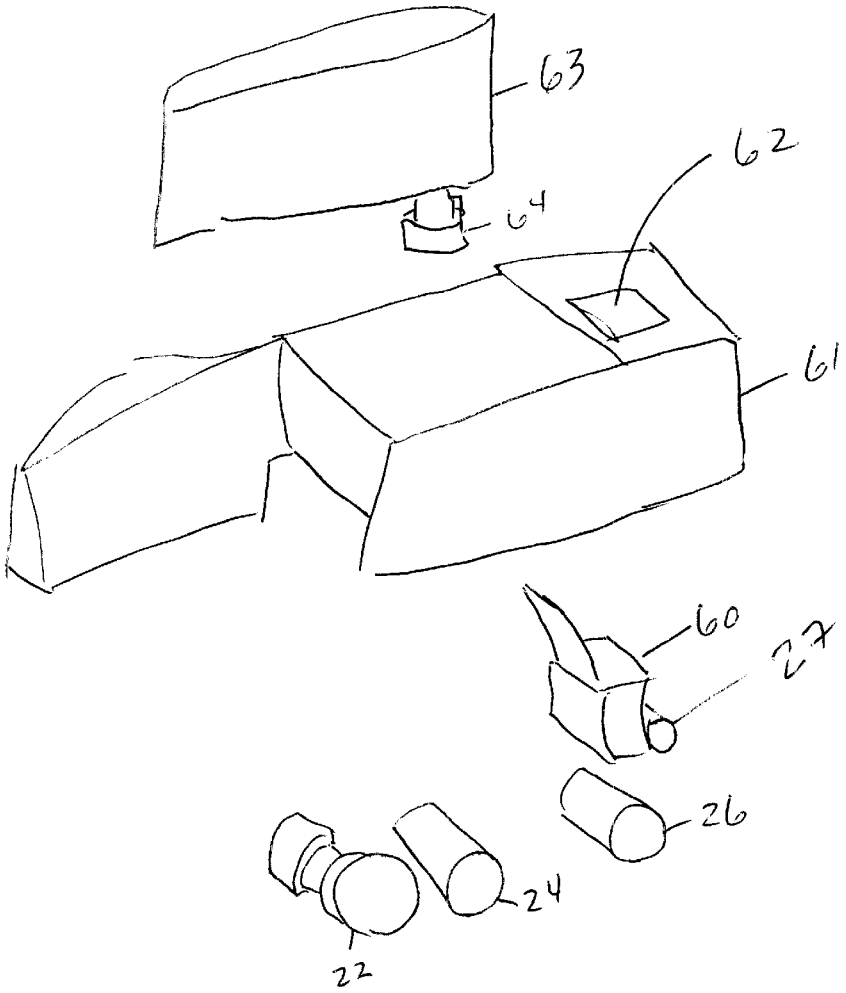
FIG. 5 shows in exploded and perspective view some of the feeder elements of FIG. 1 along with a moistener and a water bottle.
Figure 5:
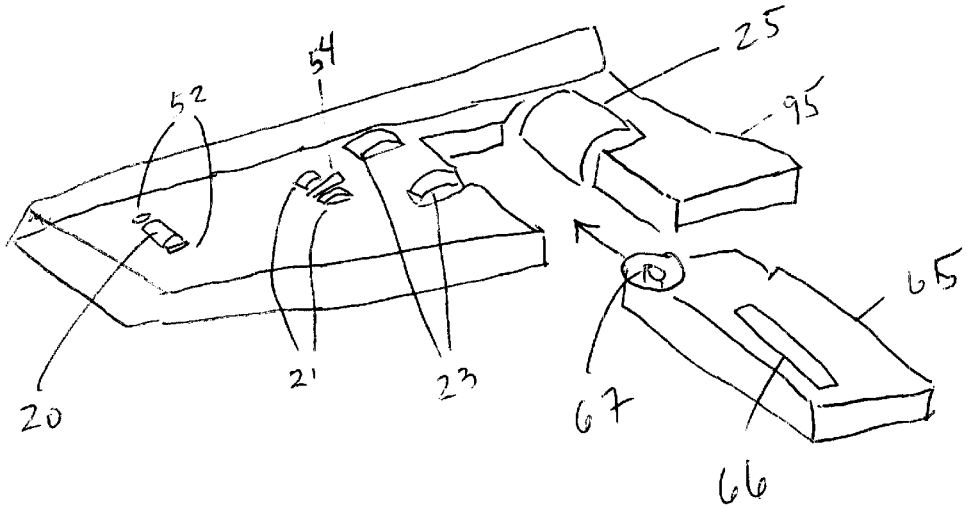

FIG. 5 shows in exploded and perspective view some of the feeder elements of FIG. 1 along with a moistener assembly 65 and a water bottle 63. Plate 95 defines the paper path previously described, and protruding upwards through plate 95 are roller 20, bipartate roller 21, rollers 23, and roller 25. Lever end 54 is visible between portions of roller 21. Lever ends 52 are visible astride roller 20. In the exploded view of FIG. 5, roller 22 is visible above roller 21, and rollers 24 and 26 are visible above rollers 23 and 25. A tape or label feeder housing 60 permits stacking labels nearby to roller 27 for label feeding, and the housing is accessible to the user through opening 62 in housing 61. In normal operation, housing 61 is attached to plate 95 and most of the moving parts of the feeder are protected by housing 61 and by other housings omitted for clarity in FIG. 5.

Moistener 65 is slidable into a corresponding recess in the plate 95. While it is considered preferable that this motion be linear and at right angles to the paper path direction, those skilled in the art will appreciate that this motion could be at some other angle or could be rotary motion about a pivot axis such as a vertical axis, all without departing from the invention. A sponge or brush assembly 66 is positioned so as to seal envelope flaps as envelopes pass along the paper path.

Insertion of the moistener 65 into the plate 95 accomplishes at least two important results. First, a receptacle 67 is thereby positioned to receive a valve 64 of a water bottle 63. In this way, water is dispensed into the moistener as needed to make up for water used in sealing, and water lost to evaporation. Second, one or more cam surfaces on moistener 65 cause rollers 23, 25 to be urged upwards in a spring-loaded way.

Thus, the removable feeder permits easy cleaning, replacement of wear parts such as sponges and brushes, and the clearing of jams.

A lever, omitted for clarity in the figures, permits the user to select whether the moistener will or will not moisten and seal envelopes. This raises or lowers the sponge or brush assembly 66 relative to the paper path. Preferably the linkage between this lever and the moistener is such that the moistener may be removed regardless of the position of this lever.

It will thus be appreciated by those skilled in the art that the removable moistener 65 is of great help in the clearing of document jams. When a jam occurs, the user removes the bottle 63 and gently pulls out the moistener 65 outward. If the jam was connected with the sponge or brush assembly 66, then it may be readily cleared because the assembly 66 is in plain view and is fully accessible. Furthermore, removal of the moistener 65 relaxes the usual upward spring loading of the rollers 23, 25 and allows them to move downward. This helps in removing any jammed mail piece or foreign matter that was previously difficult to remove due to the rollers 23, 25.

The separation concept used herein offers many improvements over earlier feeders. The system requires no active server elements, and carries out its task with steady rotation of the intake rollers. There is no need for stopping and starting as with some feeders and separation rollers. The rollers are radially symmetric, as distinguished from some more trouble-prone rollers that have a bump in one area to assist in separation. The separation system avoids the use of cams and cam followers which bring about cyclic, trouble-prone movements of active elements.

Those skilled in the art will have no difficulty devising myriad obvious variations on the invention, all of which are intended to be encompassed by the claims which follow.

What is claimed is:

1. A document feeder defining a paper path with an entrance end and an exit direction, the feeder disposed to feed documents having a weight, the feeder comprising:

a first roller below the paper path at the entrance end, a stacking guide defining a document stack area above said first roller, a second roller below the paper path located in the exit direction from the first roller and from the stack area, a third roller above the paper path and above the second roller, said first and second rollers rotating in a direction urging documents in the exit direction, said third roller rotating in a direction urging documents away from the exit direction, a lever having first and second ends, a pivot located below the paper path and between the first and second rollers, said lever movable between a first position in which the first end is downward and the second end is upward and a second position in which the first end is upward and the second end is downward, said first end disposed near said first roller, said second end disposed near said second and third rollers, said first end urged downward and toward said first position by the weight of any documents in the stack area, said first end shaped and positioned when in said first position to permit any documents in the stack area to touch the first roller, said first end shaped and positioned when in said second position to lift any documents in the stack area upward and out of contact with the first roller, and said second end forced downward and toward said second position upon passage of a document between the second and third rollers;

whereby passage of a document between the second and third rollers causes any documents in the stack area to move upward and out of contact with the first roller.

2. The feeder of claim 1 wherein the stacking guide is adjustable, thereby accommodating documents of varying sizes.

3. The feeder of claim 1 wherein the tangential velocity of the second roller is greater than the tangential velocity of the first roller.

4. The feeder of claim 1 further comprising fourth and fifth rollers disposed in the exit direction from the second and third rollers, said fourth roller having a tangential velocity greater than that of the second roller, and said fifth roller being an idler roller.

5. A method for use with a document feeder defining a paper path with an entrance end and an exit direction, the feeder disposed to feed documents, the feeder comprising a first roller below the paper path at the entrance end, a stacking guide defining a document stack area above said first roller, and a second roller below the paper path located in the exit direction from the first roller and from the stack area, the method comprising the steps of:

allowing documents in the stack area to come in contact with the first roller, passing a lowermost document in the stack area in the exit direction, lifting the documents in the stack area above the first roller when the lowermost document reaches the second roller, and allowing documents in the stack area to come in contact with the first roller after the lowermost document has passed the second roller.

* * * * *

UNITED STATES PATENT AND TRADEMARK OFFICE

CERTIFICATE OF CORRECTION

PATENT NO. : 6,422,554 B1 
DATED : July 23, 2002
INVENTOR(S) : Heinz Wuethrich et al.

It is certified that error appears in the above-identified patent and that said Letters Patent is hereby corrected as shown below:

Title page should be deleted and substitute therefore the attached title page.

Drawing sheets consisting of Figs. 1 - 6 should be deleted to be replaced with the attached drawing sheets.

Signed and Sealed this

First Day of April, 2003

JAMES E. ROGAN
*Director of the United States Patent and Trademark Office*

(12) United States Patent
Wuethrich et al.

(10) Patent No.: US 6,422,554 B1
(45) Date of Patent: Jul. 23, 2002

(54) DOCUMENT FEEDER WITH PIVOTED LEVER

(75) Inventors: Heinz Wuethrich, Bern; Stefan Kaeser, Olten; Thomas Gasser, Bern, all of (CH)

(73) Assignee: Ascom Hasler Mailing Systems AG, Bern (CH)

( * ) Notice: Subject to any disclaimer, the term of this patent is extended or adjusted under 35 U.S.C. 154(b) by 0 days.

(21) Appl. No.: 09/505,353

(22) Filed: Feb. 16, 2000

(51) Int. Cl.[7] ..... B65H 1/24

(52) U.S. Cl. ..... 271/166; 271/137; 271/134; 271/117

(58) Field of Search ..... 271/117, 122, 271/126, 127, 131, 134, 137, 144, 166

(56) References Cited

U.S. PATENT DOCUMENTS

| | | | | |
|---|---|---|---|---|
| 549,111 A | | 11/1895 | Crowell | |
| 2,627,406 A | | 2/1953 | Mestre | 270/58 |
| 3,540,970 A | | 11/1970 | Huntwork | 156/556 |
| 3,949,981 A | | 4/1976 | McInerney | 271/178 |
| 4,034,975 A | | 7/1977 | Agnew et al. | 271/10 |
| 4,212,456 A | * | 7/1980 | Ruenzi | 271/127 X |
| 4,714,243 A | * | 12/1987 | Staniszewski | 271/127 X |
| 4,884,796 A | * | 12/1989 | Daboub | 271/126 X |
| 4,948,453 A | | 8/1990 | Nobile et al. | 156/441.5 |
| 5,370,380 A | * | 12/1994 | Suzuki et al. | 271/127 X |
| 5,674,348 A | | 10/1997 | DeFiguerido | 156/441.5 |

FOREIGN PATENT DOCUMENTS

| | | |
|---|---|---|
| DE | 295 08 615 | 9/1996 |
| DE | 295 08 615 U1 | 10/1996 |
| GB | 1519901 | 8/1978 |

OTHER PUBLICATIONS

Patent Abstracts of Japan, Publication No.: 9315609, Title: Delivery Device for Mail.

Patent Abstracts of Japan, vol. 1998, No. 4, Mar. 31, 1998 JP 09315609.

* cited by examiner

*Primary Examiner*—Christopher P. Ellis
*Assistant Examiner*—Patrick Mackey
(74) *Attorney, Agent, or Firm*—Perman & Green, LLP

(57) ABSTRACT

A document feeder employs a lifting lever to lift stacked documents away from a feed roller each time a document is being fed away from the stack. In this way the separation of documents is enhanced, providing a mechanism that more readily accommodates documents of varying shapes, thicknesses, and materials. The feeder uses a motor linked by one-way clutches to feed mechanisms for documents and for labels, stacked separately. The motor is driven in one direction to feed documents and in the other direction to feed labels. A moistener is provided below the paper path, and the moistener is mounted so that it can be slidably removed. When it is removed, feed rollers are permitted to relax and move apart which helps in the clearing of jams.

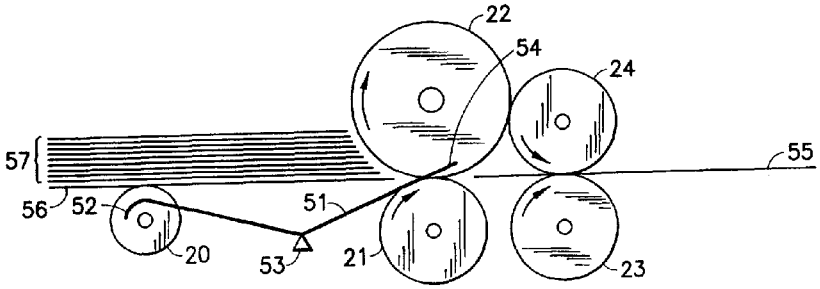

5 Claims, 6 Drawing Sheets